US009978322B2

(12) United States Patent
Namkung et al.

(10) Patent No.: US 9,978,322 B2
(45) Date of Patent: May 22, 2018

(54) DISPLAY APPARATUS

(71) Applicant: Samsung Display Co., Ltd., Yongin, Gyeonggi-Do (KR)

(72) Inventors: Hyunkyu Namkung, Cheonan-si (KR); Kuk-Hwan Ahn, Hwaseong-si (KR); Jai-Hyun Koh, Hwaseong-si (KR); Heendol Kim, Yongin-si (KR); Seokyun Son, Yongin-si (KR); Ik Soo Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 30 days.

(21) Appl. No.: 14/822,735

(22) Filed: Aug. 10, 2015

(65) Prior Publication Data

US 2016/0155400 A1 Jun. 2, 2016

(30) Foreign Application Priority Data

Dec. 2, 2014 (KR) ..... 10-2014-0170674

(51) Int. Cl.
*G09G 3/36* (2006.01)

(52) U.S. Cl.
CPC ..... *G09G 3/3614* (2013.01); *G09G 3/3607* (2013.01); *G09G 3/3677* (2013.01); *G09G 2300/0426* (2013.01); *G09G 2300/0452* (2013.01); *G09G 2310/08* (2013.01); *G09G 2320/0209* (2013.01)

(58) Field of Classification Search
CPC .. G09G 3/3614; G09G 3/3607; G09G 3/3677; G09G 3/364
See application file for complete search history.

(56) References Cited

U.S. PATENT DOCUMENTS 8,587,504 B2 11/2013 Joo
2007/0001953 A1* 1/2007 Jang ..... G09G 3/3607 345/88
2011/0156992 A1* 6/2011 Moon ..... G09G 3/3607 345/84
2013/0321032 A1* 12/2013 Chung ..... H03K 3/00 327/108

FOREIGN PATENT DOCUMENTS

KR 10-2011-0077899 A 7/2011
KR 10-1442713 B1 9/2014
KR 10-2015-0139132 12/2015

* cited by examiner

*Primary Examiner* — Dennis Joseph
(74) *Attorney, Agent, or Firm* — Innovation Counsel LLP

(57) ABSTRACT

A display apparatus includes gate lines extending in a first direction data lines extending in a second direction crossing the first direction, and pixels connected to the gate lines and the data lines. The pixels displaying first, second, third, and fourth colors are repeatedly arranged in the second direction. A k-th gate line connected to at least one of first pixels displaying the first color among the pixels arranged in an i-th row is electrically connected to a (k+j)th gate line connected to at least one of second pixels displaying the first color among pixels arranged in one row of (i+1)th, (i+2)th, and (i+3)th rows.

12 Claims, 10 Drawing Sheets

DISPLAY APPARATUS

CROSS-REFERENCE TO RELATED APPLICATION

This U.S. non-provisional patent application claims priority under 35 U.S.C. § 119 of Korean Patent Application No. 10-2014-0170674, filed on Dec. 2, 2014, the contents of which are hereby incorporated by reference in its entirety.

BACKGROUND

1. Field of Disclosure

The present disclosure relates to a display apparatus. More particularly, the present disclosure relates to a display apparatus that operates in an inversion driving scheme.

2. Description of the Related Art

A liquid crystal display generally forms an electric field in a liquid crystal layer disposed between two substrates to display an image. In particular, by controlling the strength of the electric field, the liquid crystal display is able to change the alignment of the liquid crystal molecules in the liquid crystal layer and thereby control the transmittance of light incident by the liquid crystal layer such that a desired image is displayed through the liquid crystal display.

Methods of driving the liquid crystal display include a line inversion method, a column inversion method, and a dot inversion method according to a phase of a data voltage applied to the data line. The line inversion method inverts the phase of image data applied to data lines every pixel row, the column inversion method inverts the phase of the image applied to the data lines every pixel column, and the dot inversion method inverts the phase of the image data applied to the data lines every pixel row and every pixel column.

In general, a display apparatus that shows colors using three primary colors of red, green, and blue colors includes sub-pixels respectively corresponding to the red, green, and blue colors. In recent years, a display apparatus that shows the colors using red, green, blue, and white colors has been developed.

SUMMARY

The present disclosure provides a display apparatus capable of preventing or reducing a horizontal crosstalk phenomenon and a moving line-stain phenomenon.

Embodiments of the inventive concept provide a display apparatus including a plurality of gate lines extending in a first direction, a plurality of data lines extending in a second direction crossing the first direction, and a plurality of pixels connected to the gate lines and the data lines.

The pixels displaying first, second, third, and fourth colors are repeatedly arranged in the second direction. A k-th (k is an integer number equal to or greater than 1) gate line connected to at least one of first pixels displaying the first color among the pixels arranged in an i-th (i is an integer number equal to or greater than 1) row is electrically connected to a (k+j)th (j is an integer number equal to or greater than 1) gate line connected to at least one of second pixels displaying the first color among pixels arranged in one row of (i+1)th, (i+2)th, and (i+3)th rows.

According to the above, the horizontal crosstalk phenomenon and the moving line-stain phenomenon may be substantially prevented or reduced. In addition, a flicker may be prevented from being perceived due to a difference in brightness between frame periods.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
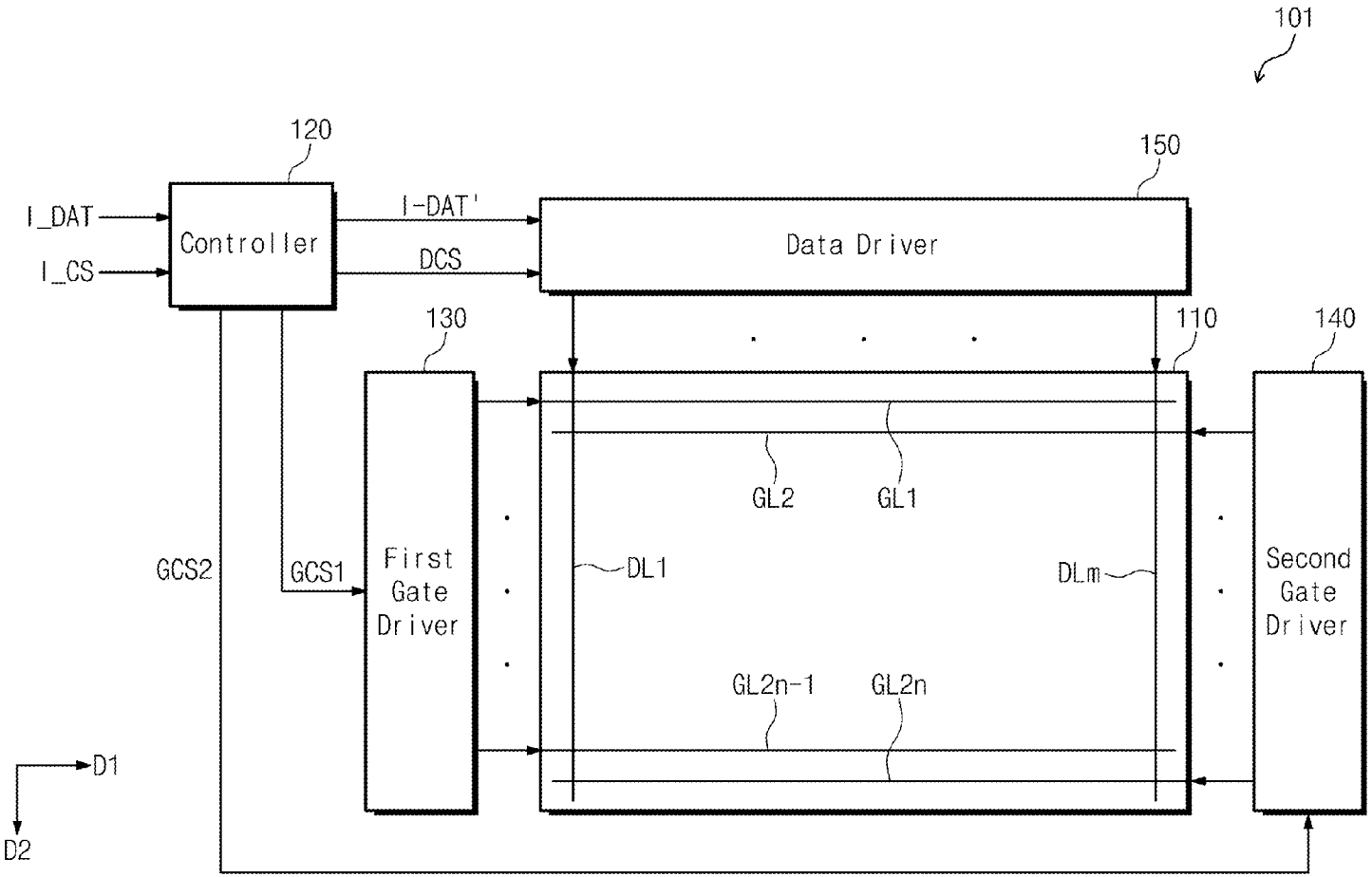
FIG. 1 is a block diagram showing a liquid crystal display device according to an exemplary embodiment of the present disclosure.

It will be understood that when an element or layer is referred to as being "on", "connected to" or "coupled to" another element or layer, it may be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections are not limited by these terms. These terms are only used to distinguish one element, component, region, layer or section from another element, component, region, layer or section. Thus, a first element, component, region, layer or section discussed below may also be referred to as a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations), and the spatially relative descriptors used herein are to be interpreted accordingly.

The terminology used herein is for the purpose of describing particular embodiments only and is not intended to be limiting of the present system and method. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the meaning as commonly understood by one of ordinary skill in the art to which this disclosure pertains. It will be further understood that terms, including those defined in commonly used dictionaries, should be interpreted as having a meaning that is consistent with their meaning in the context of the relevant art and should not be interpreted in an idealized or overly formal sense unless expressly so defined herein.

Hereinafter, the present system and method are explained in detail with reference to the accompanying drawings.

Figure 2:
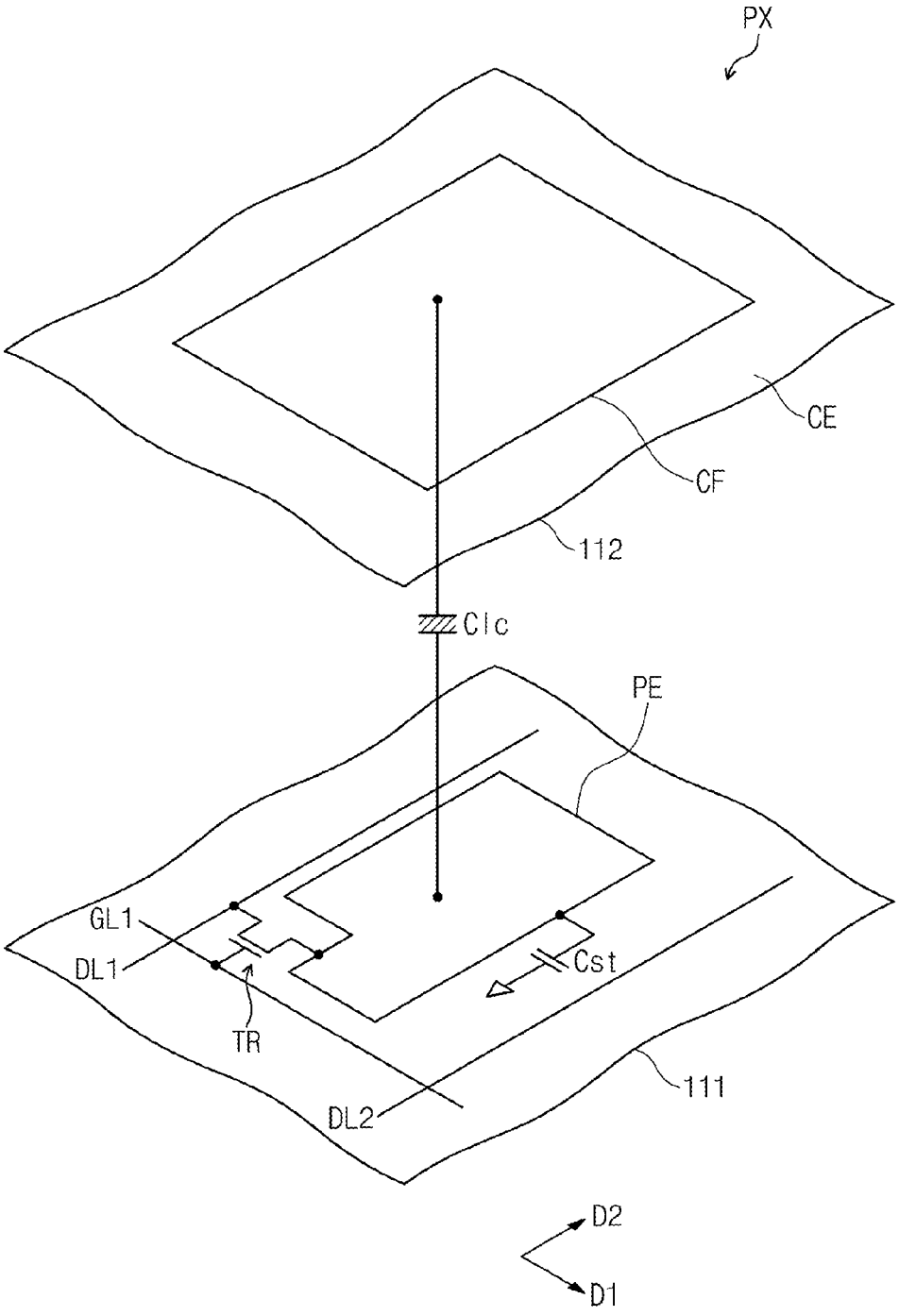
FIG. 2 is an equivalent circuit diagram showing one pixel shown in FIG. 1.

FIG. 1 is a block diagram showing a liquid crystal display device 101 according to an exemplary embodiment of the present disclosure, and FIG. 2 is an equivalent circuit diagram showing one pixel shown in FIG. 1.

Referring to FIG. 1, the liquid crystal display device 101 includes a liquid crystal panel 110, a controller 120, a first gate driver 130, a second gate driver 140, and a data driver 150.

The liquid crystal panel 110 includes a lower substrate 111, an upper substrate 112 facing the lower substrate 111, and a liquid crystal layer 113 interposed between the lower and upper substrates 111 and 112.

The liquid crystal panel 110 includes a plurality of gate lines GL1 to GL2*n* extending in a first direction D1 and a plurality of data lines DL1 to DLm extending in a second direction D2 crossing the first direction D1. The gate lines GL1 to GL2*n* and the data lines DL1 to DLm define pixel areas in which pixels PX displaying an image are arranged in a one-to-one correspondence. FIG. 2 shows a pixel arranged in a first row and a first column and connected to a first gate line GL1 and a first data line DL1 as a representative example.

Referring to FIGS. 1 and 2, the pixel PX includes a thin film transistor TR connected to the first gate line GL1 and the first data line DL1, a liquid crystal capacitor Clc connected to the thin film transistor TR, and a storage capacitor Cst connected to the liquid crystal capacitor Clc in parallel. The storage capacitor Cst may be omitted. The liquid crystal capacitor Clc includes a pixel electrode PE disposed on the lower substrate 111 and a reference electrode CE disposed on the upper substrate 112 as its two terminals, and the liquid crystal layer 113 disposed the pixel electrode PE and the common electrode CE serves as a dielectric substance of the liquid crystal capacitor Clc.

The thin film transistor TR may be disposed on the lower substrate 111. The thin film transistor TR includes a gate electrode connected to the first gate line GL1, a source electrode connected to the first data line DL1, and a drain electrode connected to the pixel electrode PE. The reference electrode CE is disposed over an entire surface of the upper substrate 112 and receives a reference voltage. In an embodiment different from that of FIG. 2, the reference electrode CE may be disposed on the lower substrate 111, and at least one of the pixel electrode PE and the reference electrode CE may include slits.

The storage capacitor Cst assists the liquid crystal capacitor Clc and includes the pixel electrode PE, a storage line (not shown), and an insulating layer disposed between the pixel electrode PE and the storage line (not shown). The storage line (not shown) is disposed on the lower substrate 111 to overlap with a portion of the pixel electrode PE. The storage line (not shown) is applied with a constant voltage, such as a storage voltage.

Although not shown in FIG. 2, according to another embodiment, the display device 101 may have a visibility improvement structure in which each pixel PX is divided into two grayscale areas. In the visibility improvement structure, each pixel PX includes at least two sub-pixels applied with data voltages based on gamma curves different from each other, and thus, the two sub-pixels display different grayscales with respect to the same input image data.

Each of the pixels PX displays one of primary colors. The primary colors may include, for example, red, green, blue, and white colors, or yellow, cyan, and magenta colors. Each of the pixels may include a color filter CF representing one of the primary colors. In FIG. 2, the color filter CF is disposed on the upper substrate 112, but it is not limited thereto or thereby. That is, the color filter CF may be disposed on the lower substrate 111.

The controller 120 receives image data I_DAT and external control signals I_CS from an external graphics controller (not shown). The external control signal I_CS includes a vertical synchronization signal as a frame distinction signal, a horizontal synchronization signal as a row distinction signal, a data enable signal, which is maintained at a high level when data are output to indicate a data input period, and a main clock signal.

The controller 120 converts the image data I-DAT into data suitable for the data driver 150 and applies the converted image data I-DAT' to the data driver 150. The controller 120 generates a first gate control signal GCS1, a second gate control signal GCS2, and a data control signal DCS on the basis of the external control signal I_CS. The controller 120 applies the first and second gate control signals GCS1 and GCS2 to the first and second gate drivers 130 and 140, respectively, and applies the data control signal DCS to the data driver 150.

The first and second gate control signals GCS1 and GCS2 are used to drive the first and second gate drivers 130 and 140, respectively, and the data control signal DCS is used to drive the data driver 150.

The first gate driver 130 is electrically connected to gate lines of a first group among the gate lines GL1 to GL2*n* of the liquid crystal panel 110 and the second gate driver 140 is electrically connected to gate lines of a second group among the gate lines GL1 to GL2*n* of the liquid crystal panel 110. As an example, the gate lines of the first group are connected to odd-numbered pixel rows, and the gate lines of the second group are connected to even-numbered pixel rows. This is described below in detail with reference to FIG. 4.

The first gate driver 130 generates odd-numbered gate signals in response to the first gate control signal GCS1 and sequentially applies the odd-numbered gate signals to the gate lines of the first group. The first gate control signal GCS1 includes a first vertical start signal indicating a start of scanning of the first gate driver 130 and at least one clock signal controlling an output timing of a gate-on voltage. The second gate driver 140 generates even-numbered gate signals in response to the second gate control signal GCS2 and sequentially applies the even-numbered gate signals to the gate lines of the second group. The second gate control signal GCS2 includes a second vertical start signal indicating a start of scanning of the second gate driver 140 and at least one clock signal controlling the output timing of the gate-on voltage.

The data driver 150 converts the image data I_DAT' to corresponding grayscale voltages in response to the data control signal DCS and applies the grayscale voltages to the data lines DL1 to DLm as the data voltages. The data voltages include a positive (+) data voltage having a positive value with respect to the reference voltage and a negative (−) data voltage having a negative value with respect to the reference voltage. The data control signal DCS includes a horizontal start signal indicating a start of transmitting of the image data I_DAT' to the data driver 150, a load signal indicating application of the data voltages to the data lines DL1 to DLm, and an inversion signal inverting the polarity of the data voltages with respect to the reference voltage.

The polarity of the data voltages applied to the pixels PX is inverted after one frame is finished and before a next frame starts to prevent liquid crystal molecules from deteriorating and burning. That is, the polarity of the data voltage is inverted every one frame in response to the inversion signal applied to the data driver 150. The liquid crystal panel 110 is operated in a manner in which the data voltages having different polarities from each other are alternately applied to the data lines DL1 to DLm in the unit of at least one data line during each frame the image is displayed. Operating in such manner improves the image display quality.

Each of the controller 120, the first and second gate drivers 130 and 140, and the data driver 150 may be directly mounted on the liquid crystal panel 110 in at least one integrated circuit chip, connected to the liquid crystal panel 110 as a tape carrier package (TCP) after being mounted on a flexible printed circuit board, or mounted on a separate printed circuit board. As an alternative, the first and second gate drivers 130 and 140 may be directly integrated on the liquid crystal panel 110 together with the gate lines GL1 to GL2*n*, the data lines DL1 to DLm, and the thin film transistor TR. In addition, the controller 120, the first and second gate drivers 130 and 140, and the data driver 150 may be integrated in a single chip.

The display apparatus 101 may further include a backlight unit (not shown) disposed at a rear side of the liquid crystal panel 110 and configured to generate a light. The backlight unit may include a light emitting diode or a cold cathode fluorescent lamp as its light source.

Figure 3:
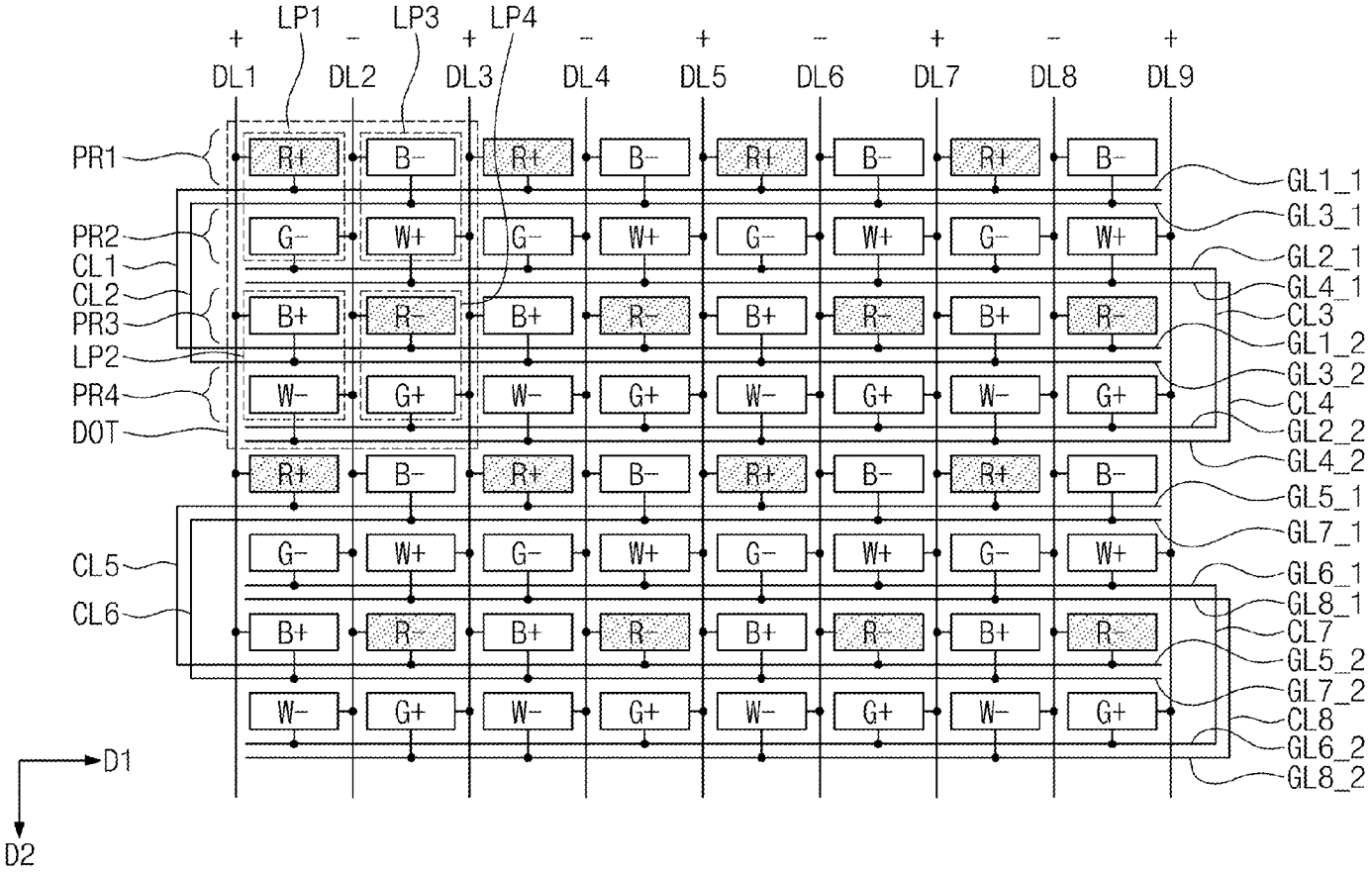
FIG. 3 is a plan view showing a portion of a liquid crystal panel according to an exemplary embodiment of the present disclosure.

FIG. 3 is a plan view showing a portion of a liquid crystal panel according to an exemplary embodiment of the present disclosure.

Referring to FIG. 3, the pixels are arranged in the first and second directions D1 and D2 as a matrix form. For the convenience of explanation, a set of the pixels arranged in the first direction D1 is referred to as a pixel row, and a set of the pixels arranged in the second direction D2 is referred to as a pixel column.

Among the pixel rows, a k-th gate line (k is an integer number equal to or greater than 1) and a (k+1)th gate line are disposed between an i-th pixel row (i is an integer number equal to or greater than 1) and an (i+1)th pixel row. A first pixel group of the i-th pixel row is connected to the k-th gate line, and a second pixel group of the i-th pixel row is connected to the (k+1)th gate line. The first pixel group includes the pixels arranged in odd-numbered pixel columns of the i-th pixel row, and the second pixel group includes the pixels arranged in even-numbered pixel columns of the i-th pixel row.

Among the pixel columns, a h-th pixel column (h is an integer number equal to or greater than 1) includes the pixels arranged between a h-th data line and a (h+1)th data line. A third pixel group of the h-th pixel column is connected to the h-th data line, and a fourth pixel group of the h-th pixel column is connected to the (h+1)th data line. The pixels arranged in the h-th pixel column are alternately connected to the h-th data line and the (h+1)th data line in the unit of at least one pixel. As an example, the third pixel group includes the pixels arranged in the odd-numbered pixel rows of the pixels arranged in the h-th pixel column and the fourth pixel group includes the pixels arranged in the even-numbered pixel rows of the pixels arranged in the h-th pixel column.

Among the pixels, a red pixel having a red color, a green pixel having a green color, a blue pixel having a blue color, and a white pixel having a white color are indicated by R, G, B, and W, respectively. In addition, the red, green, blue, and white pixels applied with the positive (+) data voltage during an i-th (i is a natural number) frame period are indicated by R+, G+, B+, and W+, respectively, and the red, green, blue, and white pixels applied with the negative (−) data voltage during the i-th frame period are indicated by R−, G−, B−, and W−, respectively.

The polarity of the data voltages applied to the pixels of the liquid crystal panel 110 shown in FIG. 3 indicates the polarity of the data voltages in an m-th (m is an integer number equal to or greater than 1) frame period, and the polarity of the data voltages applied to the pixels during an (m+1)th frame period is inverted. That is, the data driver 150 shown in FIG. 1 inverts the polarity of the data voltages applied to the data lines DL1 to DLm every frame period. In addition, the polarity of the data voltages is inverted every one data line.

The red, green, blue, and white pixels R, G, B, and W are repeatedly arranged in the second direction D2 on the liquid crystal panel 110. Each of the red, green, blue, and white pixels R, G, B, and W has a horizontal pixel structure in which a width (hereinafter, referred to as a horizontal width) in the first direction D1 of each of the red, green, blue, and white pixels R, G, B, and W is greater than a width (hereinafter, referred to as a vertical width) in the second direction D2 of each of the red, green, blue, and white pixels R, G, B, and W. In the present exemplary embodiment, a ratio of the horizontal width to the vertical width ranges from 2:1 to 3:1.

Among the pixels arranged in the i-th pixel row, the k-th gate line connected to first pixels displaying a first color is electrically connected to a (k+j)th gate line (j is an integer number equal to or greater than 1) connected to second pixels displaying the first color among the pixels arranged in one row of (i+1)th, (i+2)th, and (i+3)th rows.

FIG. 3 shows pixels arranged in eight rows by eight columns as a representative example. To operate the pixels arranged in eight rows by eight columns, first to ninth data lines DL1 to DL9 and first to sixteenth gate lines GL1 to GL16 are required.

The pixels arranged in the h-th column include a first logic pixel LP1 and a second logic pixel LP2, which are sequentially arranged in the second direction D2, and the pixels in the (h+1)-th column include a third logic pixel LP3 and a fourth logic pixel LP4, which are sequentially arranged in the second direction D2. Each of the first to fourth logic pixels LP1 to LP4 includes an even number of pixels. The first and third logic pixels LP1 and LP3 are disposed adjacent to each other in the first direction D1, and the second and fourth logic pixels LP2 and LP4 are disposed adjacent to each other in the first direction D1.

Each of the first and fourth logic pixels LP1 and LP4 includes two pixels of the red, green, blue, and white pixels R, G, B, and W, and each of the second and third logic pixels LP2 and LP3 includes the other two pixels of the red, green, blue, and white pixels R, G, B, and W. In the present exemplary embodiment, the first logic pixel LP1 includes the red and green pixels R and G, and the second logic pixel LP2 includes the blue and white pixels B and W. The third logic pixel LP3 includes the blue and white pixels B and W, and the fourth logic pixel LP4 includes the red and green pixels R and G. The first to fourth logic pixels LP1 to LP4 define one dot DOT, and the dot DOT is repeatedly arranged in the first and second directions D1 and D2.

The red and blue pixels R and B are alternately arranged in a first pixel row PR1 along the first direction D1, the red pixels R of the first pixel row PR1 are connected to the first gate line GL1_1, and the blue pixels B of the first pixel row PR1 are connected to the second gate line GL3_1. The green and white pixels G and W are alternately arranged in a second pixel row PR2 along the first direction D1, the green pixels G of the second pixel row PR2 are connected to the third gate line GL2_1, and the white pixels W of the second pixel row PR2 are connected to the fourth gate line GL4_1. The blue and red pixels B and R are alternately arranged in a third pixel row PR3 along the first direction D1, the red pixels R of the third pixel row PR3 are connected to the fifth gate line GL1_2, and the blue pixels B of the third pixel row PR3 are connected to the sixth gate line GL3_2. The white and green pixels W and R are alternately arranged in a fourth pixel row PR4, the green pixels G of the fourth pixel row PR4 are connected to the seventh gate line GL2_2, and the white pixels W of the fourth pixel row PR4 are connected to the eighth gate line GL4_2.

The first gate line GL1_1 is electrically connected to the fifth gate line GL1_2 through a first connection line CL1, and the second gate line GL3_1 is electrically connected to the sixth gate line GL3_2 through a second connection line CL2. The third gate line GL2_1 is electrically connected to the seventh gate line GL2_2 through a third connection line CL3, and the fourth gate line GL4_1 is electrically connected to the eighth gate line GL4_2 through a fourth connection line CL4.

Since the first and fifth gate lines GL1_1 and GL1_2 are electrically connected to each other, the red pixels R+(hereinafter, referred to as first red pixels) of the first pixel row PR1 and the red pixels R− (hereinafter, referred to as second red pixels) of the third pixel row PR3 are substantially simultaneously operated during the same horizontal scan period 1H in response to the same gate signal. The first red pixels R+ receive the data voltages having different polarities from those of the data voltages applied to the second red pixels R−. For instance, when the first red pixels R+ receive the positive data voltages, the second red pixels R− receive the negative data voltages. Accordingly, a sum of the polarities of the pixels displaying the red color during the 1H period is zero (0), and thus the polarity of the pixels may be prevented from being biased to the positive or negative polarity.

In addition, the first red pixels R+ are arranged in the odd-numbered pixel column, and the second red pixels R− are arranged in the even-numbered pixel column. The first and second red pixels R+ and R− are spaced apart from each other by one pixel in the first direction D1. In two pixel columns, the first red pixels R+ are alternately arranged with the second red pixels R− along the second direction D2. Therefore, a difference in brightness between the first red pixels R+ and the second red pixels R− is offset in the two pixel columns, and thus a moving line-stain, in which a vertical line seems to move in the first direction when the m-th frame period is changed to the (m+1)th frame period, may be prevented from occurring.

Since the second and sixth gate lines GL3_1 and GL3_2 are electrically connected to each other, the blue pixels B− (hereinafter, referred to as first blue pixels) of the first pixel row PR1 and the blue pixels B+(hereinafter, referred to as second blue pixels) of the third pixel row PR3 are substantially simultaneously operated in response to the same gate signal. The first blue pixels B− receive the data voltages having different polarities from those of the data voltages applied to the second blue pixels B+. For instance, when the first blue pixels B− receive the negative data voltages, the second blue pixels B+ receive the positive data voltages. The first blue pixels B− are arranged in the even-numbered pixel columns, and the second blue pixels B+ are arranged in the odd-numbered pixel columns.

Since the third and seventh gate lines GL2_1 and GL2_2 are electrically connected to each other, the green pixels G− (hereinafter, referred to as first green pixels) of the second pixel row PR2 and the green pixels G+(hereinafter, referred to as second green pixels) of the fourth pixel row PR4 are substantially simultaneously operated in response to the same gate signal. The first green pixels G− receive the data voltages having different polarities from those of the data voltages applied to the second green pixels G+. For instance, when the first green pixels G− receive the negative data voltages, the second green pixels G+ receive the positive data voltages. The first green pixels G− are arranged in the odd-numbered pixel columns, and the second green pixels G+ are arranged in the even-numbered pixel columns.

Since the fourth and eighth gate lines GL4_1 and GL4_2 are electrically connected to each other, the white pixels W+(hereinafter, referred to as first white pixels) of the second pixel row PR2 and the white pixels W− (hereinafter, referred to as second white pixels) of the fourth pixel row PR4 are substantially simultaneously operated in response to the same gate signal. The first white pixels W+ receive the data voltages having different polarities from those of the data voltages applied to the second white pixels W-. For instance, when the first white pixels W+ receive the positive data voltages, the second white pixels W− receive the negative data voltages. The first white pixels W+ are arranged in the even-numbered pixel columns, and the second white pixels W− are arranged in the odd-numbered pixel columns.

Thus, during the 1H period, the sum of the polarities of the pixels displaying one of the red, green, blue, and white colors is zero (0), and thus the sum of the polarities of the pixels may be prevented from being biased to the positive or negative polarity. As a result, the reference voltage is prevented from being rippled to the negative or positive polarity due to the coupling between the data lines and the reference electrode, thereby preventing or reducing occurrences of a horizontal crosstalk phenomenon.

Figure 4:
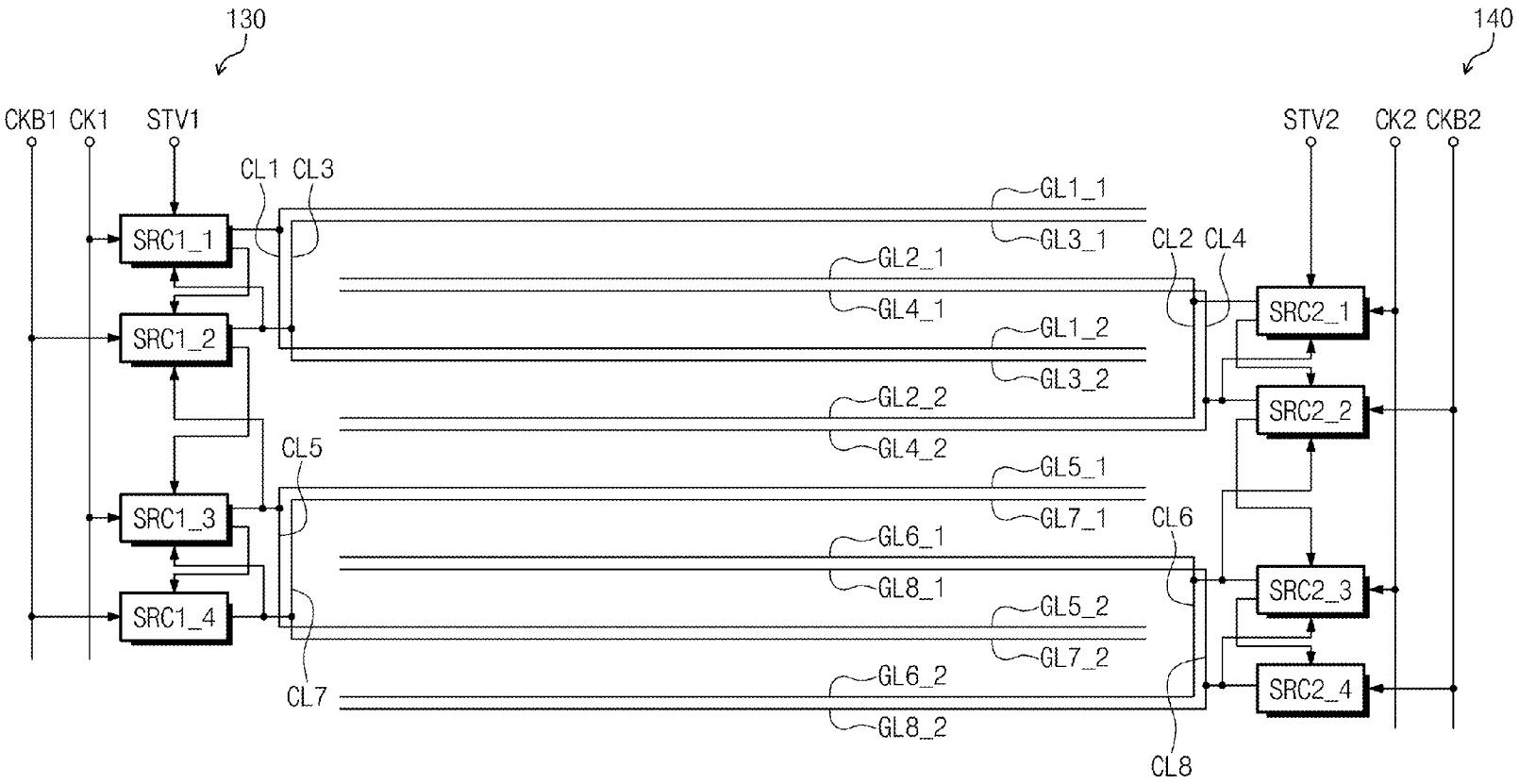
FIG. 4 is a block diagram showing an operation relation between gate lines and first and second gate drivers shown in FIG. 1.
Figure 5:
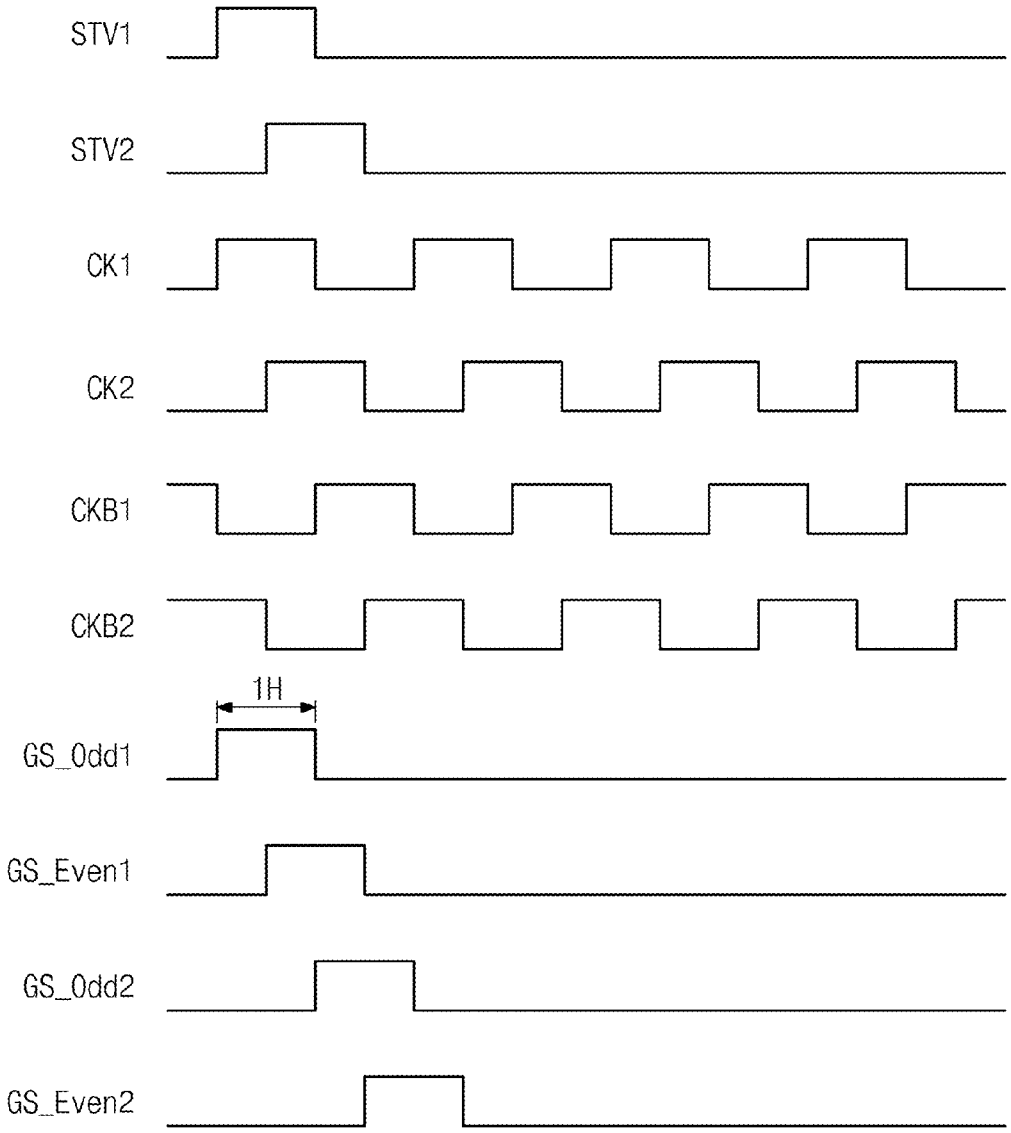
FIG. 5 is a waveform diagram showing signals shown in FIG. 4.

FIG. 4 is a block diagram showing an operation relation between the gate lines and the first and second gate drivers shown in FIG. 1, and FIG. 5 is a waveform diagram showing signals shown in FIG. 4.

Referring to FIG. 4, the first gate driver 130 includes a plurality of odd-numbered stages SRC1_1, SRC12, SRC1_3, and SRC1_4 connected to each other one after another. For the convenience of explanation, FIG. 4 shows four odd-numbered stages, but the number of the odd-numbered stages is not limited to four. The first gate driver 130 receives a first vertical start signal STV1 and first and second clock signals CK1 and CKB1 from the controller 120 (refer to FIG. 1) as the first gate control signal GCS1. The odd-numbered stages SRC1_1, SRC12, SRC1_3, and SRC1_4 start their operation in response to the first vertical start signal STV1 and sequentially output odd-numbered gate signals on the basis of the first and second clock signals CK1 and CKB1.

The second gate driver 140 includes a plurality of even-numbered stages SRC2_1, SRC2_2, SRC2_3, and SRC2_4 connected to each other one after another. For the convenience of explanation, FIG. 4 shows four even-numbered stages, but the number of the even-numbered stages is not limited to four. The second gate driver 140 receives a second vertical start signal STV2 and third and fourth clock signals CK2 and CKB2 from the controller 120 (refer to FIG. 1) as the second gate control signal GCS2. The even-numbered stages SRC2_1, SRC2_2, SRC2_3, and SRC2_4 start their operation in response to the second vertical start signal STV2 and sequentially output even-numbered gate signals on the basis of the third and fourth clock signals CK2 and CKB2.

Among the odd-numbered stages SRC1_1, SRC12, SRC1_3, and SRC1_4, a first odd-numbered stage SRC1_1 is electrically connected to the first and fifth gate lines GL1_1 and GL1_2 and applies a first odd-numbered gate signal GS_Odd1 to the first and fifth gate lines GL1_1 and GL1_2. Among the odd-numbered stages SRC1_1, SRC1_2, SRC1_3, and SRC1_4, a second odd-numbered stage SRC1_2 is electrically connected to the second and sixth gate lines GL3_1 and GL3_2 and applies a second odd-numbered gate signal GS_Odd2 to the second and sixth gate lines GL3_1 and GL3_2. The first and second clock signals CK1 and CKB1 have phases opposite to each other, and in this case, the first odd-numbered gate signal GS_Odd1 and the second odd-numbered gate signal GS_Odd2 have a time difference of about 1H period.

The first and fifth gate lines GL1_1 and GL1_2 substantially simultaneously receive the first odd-numbered gate signal GS_Odd1 from the first odd-numbered stage SRC1_1, and the pixels connected to the first and fifth gate lines GL1_1 and GL1_2 are substantially simultaneously operated during the same 1H period. Similarly, the second and sixth gate lines GL3_1 and GL3_2 substantially simultaneously receive the second odd-numbered gate signal GS_Odd2 from the second odd-numbered stage SRC1_2, and the pixels connected to the second and sixth gate lines GL3_1 and GL3_2 are substantially simultaneously operated during the same 1H period.

Meanwhile, among the even-numbered stages SRC2_1, SRC2_2, SRC2_3, and SRC2_4, a first even-numbered stage SRC2_1 is electrically connected to the third and seventh gate lines GL2_1 and GL2_2 and applies a first even-numbered gate signal GS_Even1 to the third and seventh gate lines GL2_1 and GL2_2. Among the even-numbered stages SRC2_1, SRC22, SRC2_3, and SRC2_4, a second even-numbered stage SRC2_2 is electrically connected to the fourth and eighth gate lines GL4_1 and GL4_2 and applies a second even-numbered gate signal GS_Even2 to the fourth and eighth gate lines GL4_1 and GL4_2. The third and fourth clock signals CK2 and CKB2 have phases opposite to each other, and in this case, the third and fourth clock signals CK2 and CKB2 have a phase difference of about H/2 with respect to the first and second clock signals CK1 and CKB1, respectively. Accordingly, the first even-numbered gate signal GS_Even1 and the second even-numbered gate signal GS_Even2 have a time difference of about 1H period, and the first even-numbered gate signal GS_Even1 and the first odd-numbered gate signal GS_Odd1 have a time difference of about 1H/2 period.

The third and seventh gate lines GL2_1 and GL2_2 substantially simultaneously receive the first even-numbered gate signal GS_Even1 from the first even-numbered stage SRC2_1, and the pixels connected to the third and seventh gate lines GL2_1 and GL2_2 are substantially simultaneously operated during the same 1H period. Similarly, the fourth and eighth gate lines GL4_1 and GL4_2 substantially simultaneously receive the second even-numbered gate signal GS_Even2 from the second even-numbered stage SRC2_2, and the pixels connected to the fourth and eighth gate lines GL4_1 and GL4_2 are substantially simultaneously operated during the same 1H period.

Figure 6A:
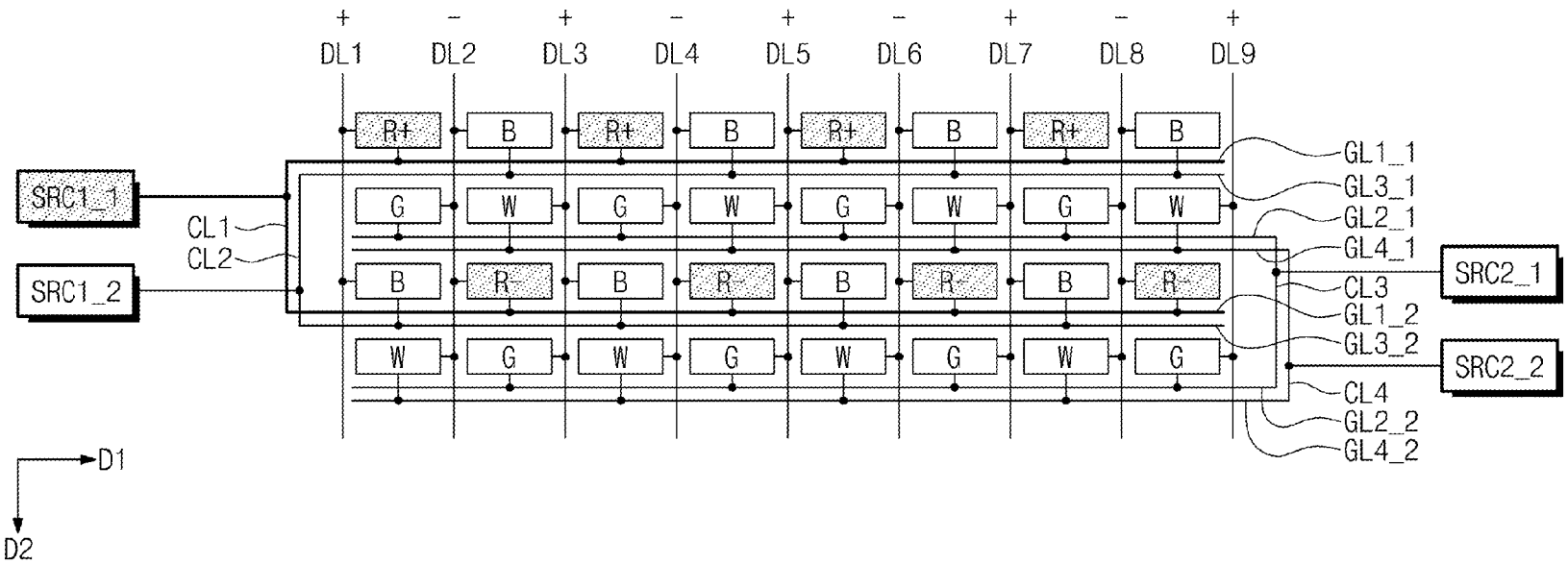
FIG. 6A is a plan view showing a turned-on state of first and second red pixels among pixels shown in FIG. 3.
Figure 6B:
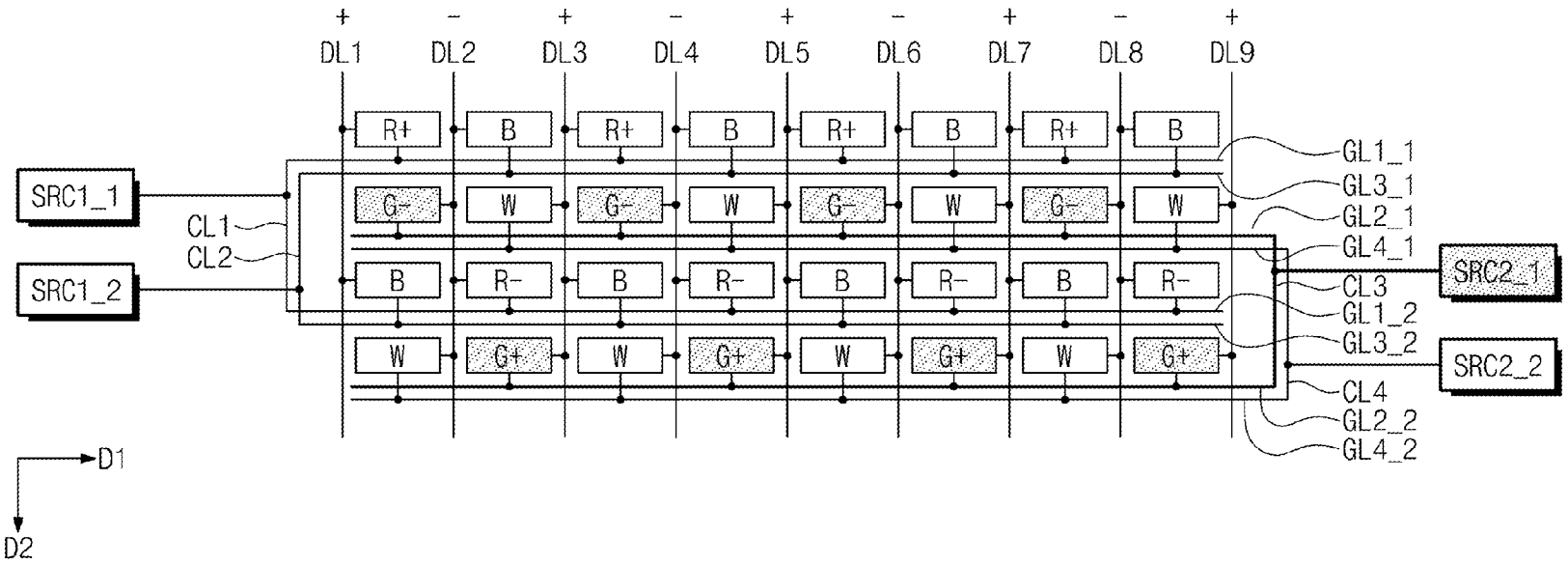
FIG. 6B is a plan view showing a turned-on state of first and second green pixels among pixels shown in FIG. 3.
Figure 6C:
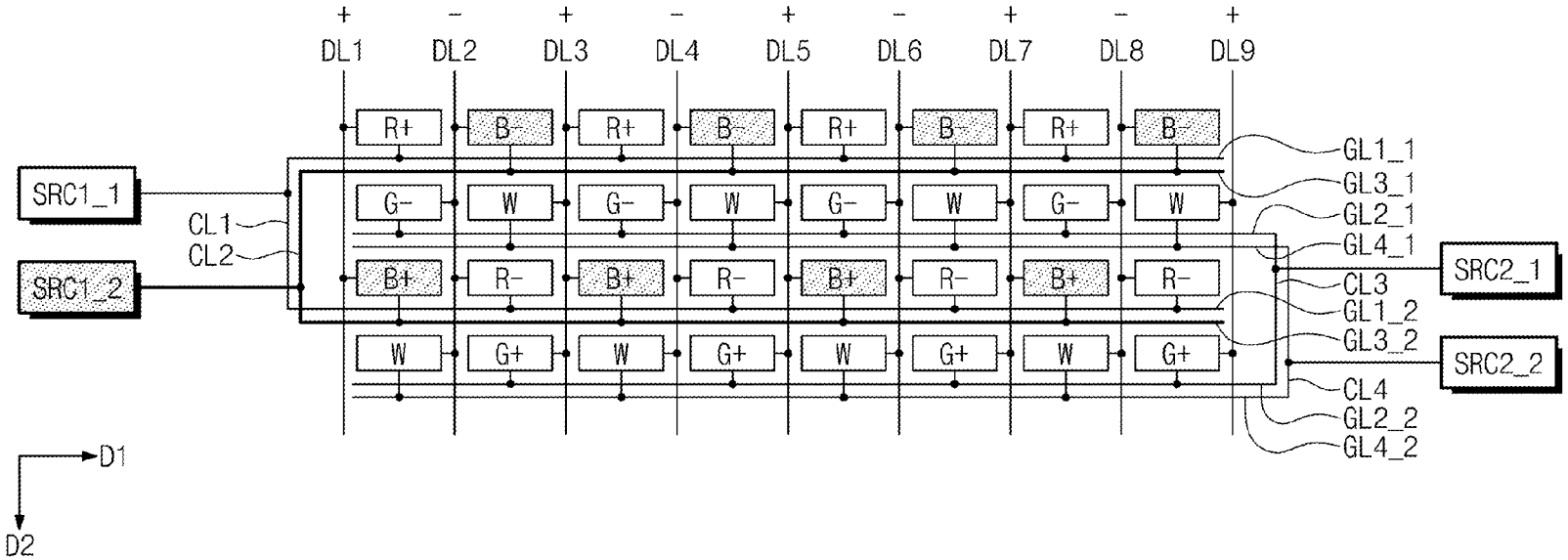
FIG. 6C is a plan view showing a turned-on state of first and second blue pixels among pixels shown in FIG. 3.
Figure 6D:
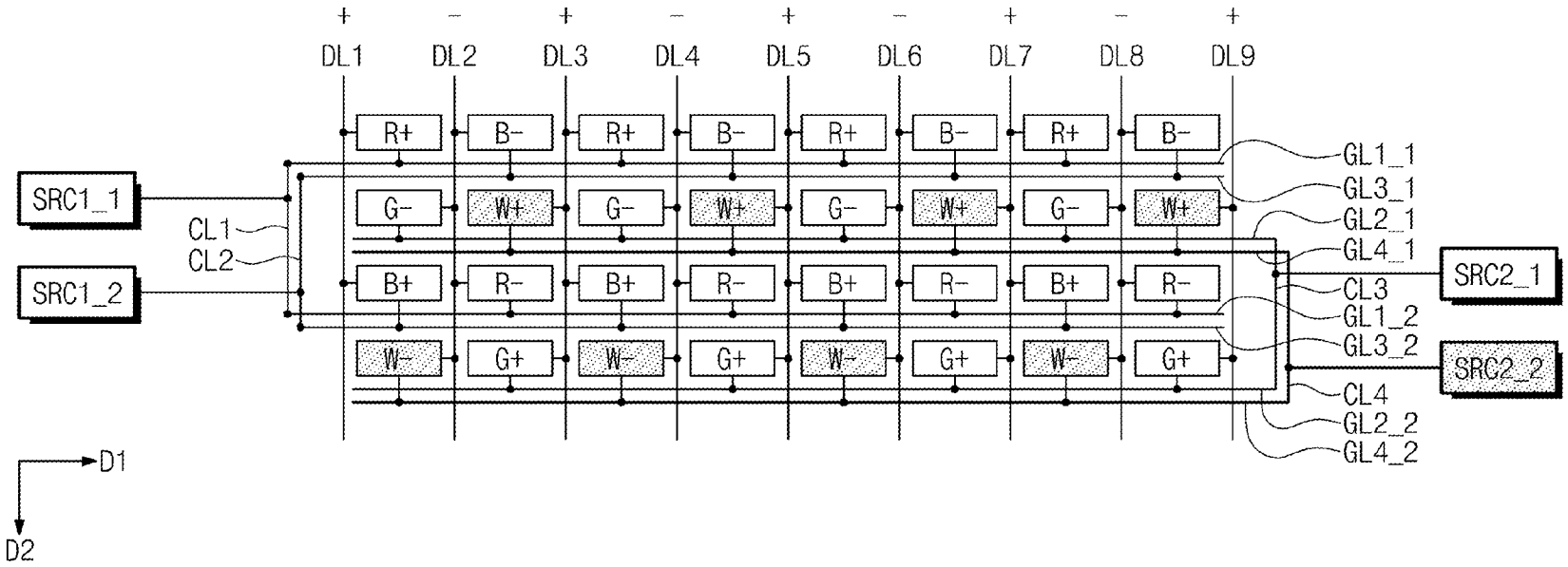
FIG. 6D is a plan view showing a turned-on state of first and second white pixels among pixels shown in FIG. 3.

FIG. 6A is a plan view showing a turned-on state of the first and second red pixels among the pixels shown in FIG. 3, FIG. 6B is a plan view showing a turned-on state of the first and second green pixels among the pixels shown in FIG. 3, FIG. 6C is a plan view showing a turned-on state of the first and second blue pixels among the pixels shown in FIG. 3, and FIG. 6D is a plan view showing a turned-on state of the first and second white pixels among the pixels shown in FIG. 3.

Referring to FIG. 6A, the first and fifth gate lines GL1_1 and GL1_2 substantially simultaneously receive the first odd-numbered gate signal GS_Odd1 from the first odd-numbered stage SRC1_1. Accordingly, the first red pixels R+ connected to the first gate line GL1_1 and the second red pixels R− connected to the fifth gate line GL1_2 are substantially simultaneously operated during the same 1H period.

The first red pixels R+ are connected to the h-th data lines DL1, DL3, DL5, DL7, and DL9 among the data lines, and the second red pixels R− are connected to the (h+1)th data lines DL2, DL4, DL6, and DL8 among the data lines. As an example, the positive data voltage is applied to the h-th data lines DL1, DL3, DL5, DL7, and DL9, and the negative data voltage is applied to the (h+1)th data lines DL2, DL4, DL6, and DL8.

Therefore, during the 1H period of the first odd-numbered gate signal GS_Odd1, the first red pixels R+ of the first pixel row PR1 are applied with the positive data voltage, and the second red pixels R− of the third pixel row PR3 are applied with the negative data voltage.

Referring to FIG. 6B, the third and seventh gate lines GL2_1 and GL2_2 substantially simultaneously receive the first even-numbered gate signal GS_Even1 from the first even-numbered stage SRC2_1. Accordingly, the first green pixels G− connected to the third gate line GL2_1 and the second green pixels G+ connected to the seventh gate line GL2_2 are substantially simultaneously operated during the same 1H period.

The first green pixels G− are connected to the (h+1)th data lines DL2, DL4, DL6, and DL8 among the data lines, and the second green pixels G+ are connected to the (h+2)th data lines DL3, DL5, DL7, and DL9 among the data lines. As an example, the positive data voltage is applied to the (h+2)th data lines DL3, DL5, DL7, and DL9, and the negative data voltage is applied to the (h+1)th data lines DL2, DL4, DL6, and DL8.

Therefore, during the 1H period of the first even-numbered gate signal GS_Even1, the first green pixels G− of the second pixel row PR2 are applied with the negative data voltage, and the second green pixels G+ of the fourth pixel row PR4 are applied with the positive data voltage.

Referring to FIG. 6C, the second and sixth gate lines GL3_1 and GL3_2 substantially simultaneously receive the second odd-numbered gate signal GS_Odd2 from the second odd-numbered stage SRC1_2. Accordingly, the first blue pixels B− connected to the second gate line GL3_1 and the second blue pixels B+ connected to the sixth gate line GL3_2 are substantially simultaneously operated during the same 1H period.

The first blue pixels B− are connected to the (h+1)th data lines DL2, DL4, DL6, and DL8 among the data lines, and the second blue pixels B+ are connected to the h-th data lines DL1, DL3, DL5, DL7, and DL9 among the data lines. As an example, the negative data voltage is applied to the (h+1)th data lines DL2, DL4, DL6, and DL8, and the positive data voltage is applied to the h-th data lines DL1, DL3, DL5, DL7, and DL9.

Therefore, during the 1H period of the second odd-numbered gate signal GS_Odd2, the first blue pixels B− of the first pixel row PR1 are applied with the negative data voltage, and the second blue pixels B+ of the third pixel row PR3 are applied with the positive data voltage.

Referring to FIG. 6D, the fourth and eighth gate lines GL4_1 and GL4_2 substantially simultaneously receive the second even-numbered gate signal GS_Even2 from the second even-numbered stage SRC2_2. Accordingly, the first white pixels W+ connected to the fourth gate line GL4_1, and the second white pixels W− connected to the eighth gate line GL4_2 are substantially simultaneously operated during the same 1H period.

The first white pixels W+ are connected to the (h+2)th data lines DL3, DL5, DL7, and DL9 among the data lines, and the second white pixels W− are connected to the (h+1)th data lines DL2, DL4, DL6, and DL8 among the data lines. As an example, the positive data voltage is applied to the (h+2)th data lines DL3, DL5, DL7, and DL9, and the negative data voltage is applied to the (h+1)th data lines DL2, DL4, DL6, and DL8.

Therefore, during the 1H period of the second even-numbered gate signal GS_Even2, the first white pixels W+ of the second pixel row PR2 are applied with the positive data voltage, and the second white pixels W− of the fourth pixel row PR4 are applied with the negative data voltage.

As described above, among the pixels displaying the same color during the 1H period in which each gate line is driven, the number of the positive pixels is substantially equal to the number of the negative pixels. Thus, the reference voltage may be prevented from being rippled to a specific polarity, and a horizontal crosstalk phenomenon may be prevented or reduced.

Figure 7:
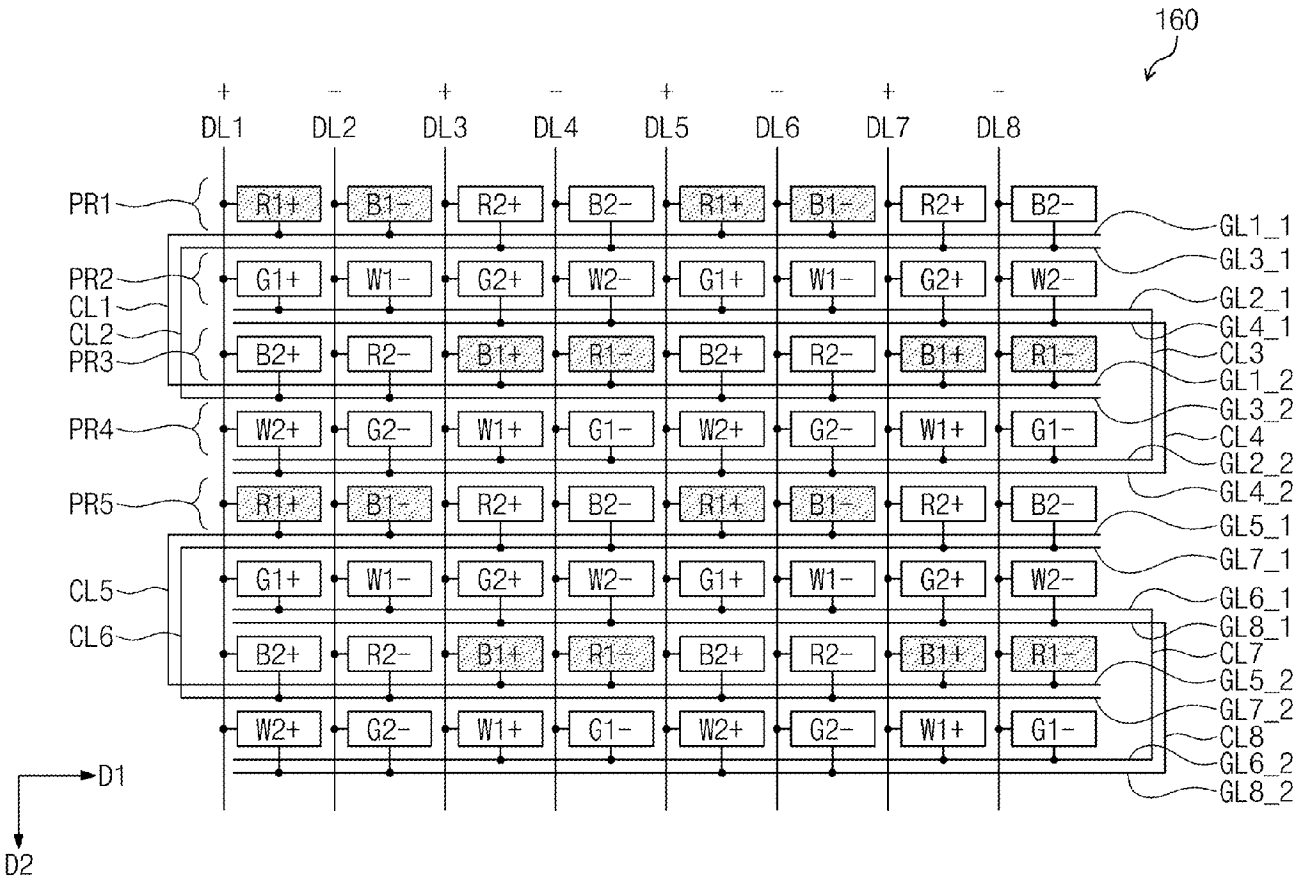
FIG. 7 is a plan view showing a portion of a liquid crystal panel according to another exemplary embodiment of the present disclosure.

FIG. 7 is a plan view showing a portion of a liquid crystal panel 160 according to another exemplary embodiment of the present disclosure. In FIG. 7, the same reference numerals denote the same elements in FIG. 3, and thus detailed descriptions of the same elements are omitted.

Referring to FIG. 7, the liquid crystal panel 160 includes red, green, blue, and white pixels R, G, B, and W repeatedly arranged in the second direction D2. Each of the red, green, blue, and white pixels R, G, B, and W has the horizontal pixel structure in which the horizontal width is greater than the vertical width.

The k-th and (k+1)th gate lines are disposed between the i-th pixel row and the (i+1)th pixel row, the first pixel group of the i-th pixel row is connected to the k-th gate line, and the second pixel group of the i-th pixel row is connected to the (k+1)th gate line.

At least one pixel among the first pixels displaying the first color of the pixels of the i-th pixel row is connected to the k-th gate line, and at least one pixel among the second pixels displaying the first color of the pixels of one of the (i+1)th, (i+2)th, and (i+3)th pixel rows is connected to the (k+j)th gate line. Here, the k-th gate line is electrically connected to the (k+j)th gate line.

FIG. 7 shows the pixels arranged in eight rows by eight columns as a representative example. To operate the pixels arranged in eight rows by eight columns, first to ninth data lines DL1 to DL9 and first to sixteenth gate lines GL1 to GL16 are required.

The red and blue pixels R and B are alternately arranged in the first pixel row PR1 along the first direction D1, and the green and white pixels G and W are alternately arranged in the second pixel row PR2 along the first direction D1. The blue and red pixels B and R are alternately arranged in the third pixel row PR3 along the first direction D1, and the white and green pixels W and G are alternately arranged in the fourth pixel row PR4 along the first direction D1.

The first and second gate lines GL1_1 and GL3_1 are disposed between the first and second pixel rows PR1 and PR2, the third and fourth gate lines GL2_1 and GL4_1 are disposed between the second and third pixel rows PR2 and PR3, the fifth and sixth gate lines GL1_2 and GL3_2 are disposed between the third and fourth pixel rows PR3 and PR4, and the seventh and eighth gate lines GL2_2 and GL4_2 are disposed between the fourth and fifth pixel rows PR4 and PR5.

Among the red pixels R of the first pixel row PR1, a first red pixel R1+ is connected to the first gate line GL1_1, and a second red pixel R2+ is connected to the second gate line GL3_1. Among the blue pixels B of the first pixel row PR1, a first blue pixel B1− is connected to the first gate line GL1_1, and a second blue pixel B2− is connected to the second gate line GL3_1.

Among the red pixels R of the third pixel row PR3, a first red pixel R1− is connected to the fifth gate line GL1_2, and a second red pixel R2− is connected to the sixth gate line GL3_2. Among the blue pixels B of the third pixel row PR3, a first blue pixel B1+ is connected to the fifth gate line GL1_2, and a second blue pixel B2+ is connected to the sixth gate line GL3_2.

The first and fifth gate lines GL1_1 and GL1_2 are electrically connected to each other through a first connection line CL1, and the second and sixth gate lines GL3_1 and GL3_2 are electrically connected to each other through a second connection line CL2. Accordingly, when the first red pixels R1+ of the first pixel row PR1 and the first blue pixels B1− of the first pixel row PR1 are turned on in response to the gate signal applied to the first gate line GL1_1, the first red pixels R1− and the first blue pixels B1+ of the third pixel row PR3 are substantially simultaneously turned on together with the first red pixels R1+ and the first blue pixels B1− of the first pixel row PR1. The first red pixels R1+ of the first pixel row PR1 and the first red pixels R1− of the third pixel row PR3 may be substantially simultaneously operated during the same 1H period by the same gate signal.

The second gate line GL3_1 receives the gate signal after a time difference of about 1H period when compared to the first gate line GL1_1. When the gate signal is applied to the second gate line GL3_1, the second red pixels R2+ and the second blue pixels B2− of the first pixel row PR1 are turned on, and substantially simultaneously, the second red pixels R2- and the second blue pixels B2+ of the third pixel row PR3 are turned on. The first red pixels R2+ of the first pixel row PR1 and the second red pixels R2− of the third pixel row PR3 are substantially simultaneously operated during the same 1H period by the same gate signal.

The first and second red pixels R1 and R2 are alternately arranged in the first and third pixel rows PR1 and PR3, and the first and second blue pixels B1 and B2 are alternately arranged in the first and third pixel rows PR1 and PR3. The first red pixels R1+ of the first pixel row PR1 are arranged in different columns from those of the first red pixels R1− of the third pixel row PR3, and the first blue pixels B1− of the first pixel row PR1 are arranged in different columns from those of the first blue pixels B1+ of the third pixel row PR3. In addition, the second red pixels R2+ of the first pixel row PR1 are arranged in different columns from those of the second red pixels R2− of the third pixel row PR3, and the second blue pixels B2− of the first pixel row PR1 are arranged in different columns from those of the second blue pixels B2+ of the third pixel row PR3.

Among the green pixels G of the second pixel row PR2, a first green pixel G1+ is connected to the third gate line GL2_1, and a second green pixel G2+ is connected to the fourth gate line GL4_1. Among the white pixels W of the second pixel row PR2, a first white pixel W1− is connected to the third gate line GL2_1, and a second white pixel W2− is connected to the fourth gate line GL4_1.

Among the green pixels G of the fourth pixel row PR4, a first green pixel G1− is connected to the seventh gate line GL2_2, and a second green pixel G2− is connected to the eighth gate line GL4_2. Among the white pixels W of the fourth pixel row PR4, a first white pixel W1+ is connected to the seventh gate line GL2_2, and a second white pixel W2+ is connected to the eighth gate line GL4_2.

The third and seventh gate lines GL2_1 and GL2_2 are electrically connected to each other through a third connection line CL3, and the fourth and eighth gate lines GL4_1 and GL4_2 are electrically connected to each other through a fourth connection line CL4. Accordingly, when the first green pixels G1+ and the first white pixels W1− of the second pixel row PR2 are turned on in response to the gate signal applied to the third gate line GL2_1, the first green pixels G1− and the first white pixels W1+ of the fourth pixel row PR4 are substantially simultaneously turned on together with the first green pixels G1+ and the first white pixels W1− of the second pixel row PR2.

The fourth gate line GL4_1 receives the gate signal after a time difference of about 1H period when compared to the third gate line GL2_1. When the gate signal is applied to the fourth gate line GL4_1, the second green pixels G2+ and the second white pixels W2− of the second pixel row PR2 are turned on, and substantially simultaneously, the second green pixels G2− and the second white pixels W2+ of the fourth pixel row PR4 are turned on.

The first green pixels G1+ and G1− are alternately arranged with the second green pixels G2+ and G2− in the second and fourth pixel rows PR2 and PR4 along the first direction D1, and the first white pixels W1− and W1+ are alternately arranged with the second white pixels W2+ and W2− in the second and fourth pixel rows PR2 and PR4 along the first direction D1. In addition, the first green pixels G1+ of the second pixel row PR2 are alternately arranged in different columns from those of the first green pixels G1− of the fourth pixel row PR4, and the first white pixels W1− of the second pixel row PR2 are alternately arranged in different columns from those of the first white pixels W1+ of the fourth pixel row PR4.

In FIG. 7, among the pixel columns, the h-th pixel column includes the pixels disposed between the h-th data lines DL1, DL3, DL5, DL7, and DL9 and the (h+1)th data lines DL2, DL4, DL6, and DL8. The pixels of the h-th pixel column are connected to the h-th data lines DL1, DL3, DL5, DL7, and DL9. The (h+1)th pixel column includes the pixels disposed between the (h+1)th data lines DL2, DL4, DL6, and DL8 and the (h+2)th data lines DL3, DL5, DL7, and DL9. The pixels of the (h+1)th pixel column are connected to the (h+1)th data lines DL2, DL4, DL6, and DL8. That is, the pixels of the h-th pixel column are not alternately connected to the h-th data lines DL1, DL3, DL5, DL7, and DL9 and the (h+1)th data lines DL2, DL4, DL6, and DL8 in the unit of at least one pixel.

The polarities of the data voltages applied to the pixels of the liquid crystal panel 160 shown in FIG. 7 represent the polarities of the data voltages in the m-th frame period, and thus the polarities of the data voltages applied to the pixels during the (m+1)th frame period are inverted. In addition, the polarities of the data voltages are inverted in the unit of one data line during one frame period.

Referring to FIG. 7, the first and second red pixels R1+ and R2+ of the first pixel row PR1 are applied with the positive data voltage, and the first and second red pixels R1− and R2− of the third pixel row PR3 are applied with the negative data voltage. The first and second blue pixels B1− and B2− of the first pixel row PR1 are applied with the negative data voltage, and the first and second blue pixels B1+ and B2+ of the third pixel row PR3 are applied with the positive data voltage.

Accordingly, during the 1H period in which the first and fifth gate lines GL1_1 and GL1_2 are operated, the sum of the polarities of the pixels displaying the red color R is zero (0), and the sum of polarities of the pixels displaying the blue color B is zero (0). Therefore, the reference voltage may be prevented from being biased to the positive or negative polarity. This effect also occurs for the other colors.

During the 1H period, the sum of the polarities of the pixels displaying one of the red, green, blue, and white colors is zero, and thus the polarities of the pixels may be prevented from being biased to the positive or negative polarity. As a result, the reference voltage is prevented from being rippled to the negative or positive polarity due to the coupling between the data lines and the reference electrode, thereby preventing or reducing occurrences of a horizontal crosstalk phenomenon.

Although the exemplary embodiments of the present system and method have been described, it is understood that the present system and method are not limited to these exemplary embodiments but various changes and modifications may be made by one of ordinary skill in the art without departing from the spirit and scope of the present system and method as hereinafter claimed.

What is claimed is:

1. A display apparatus comprising:

a plurality of gate lines extending in a first direction;

a plurality of data lines extending in a second direction crossing the first direction; and a plurality of pixels connected to the gate lines and the data lines and arranged in the first and the second directions as a matrix form comprising a plurality of rows and columns, with each row extending in the first direction and each column extending in the second direction, wherein the pixels displaying first, second, third, and fourth colors are repeatedly arranged in the second direction and the pixels in each row are grouped into first pixels including pixels in odd-numbered columns and second pixels including pixels in even-numbered columns, a k-th gate line (k is an integer equal to or greater than 1) is connected to a (k+j)th gate line (j is an integer equal to or greater than 1), wherein the k-th gate line is connected to at least one first pixel displaying the first color and not connected to at least one second pixel in an i-th row (i is an integer equal to or greater than 1), the (k+j)th gate line is connected to at least one second pixel displaying the first color and not connected to at least one first pixel in one row of (i+1)th, (i+2)th, and (i+3)th rows, and the k-th gate line and the (k+j)th gate line are configured to simultaneously provide a same gate signal to simultaneously turn on the at least one of first pixels and the at least one of second pixels during a same horizontal scan period, wherein the first pixels arranged in a h-th column are connected to the k-th gate line, and the first pixels arranged in a (h+2)th column are connected to a (k+1)th gate line, and wherein the second pixels are included in the pixels arranged in the (i+2)th row, the second pixels arranged in a (h+3)th column are connected to a (k+4)th gate line, the pixels arranged in the (h+1)th column are connected to a (k+5)th gate line, the k-th gate line is electrically connected to the (k+4)th gate line, and the (k+1)th gate line is electrically connected to the (k+5)th gate line.

2. The display apparatus of claim 1, wherein the first pixels receive data voltages having different polarities from the second pixels.

3. The display apparatus of claim 1, wherein the first, second, third, and fourth colors are red, green, blue, and white colors, respectively.

4. The display apparatus of claim 1, wherein the pixels arranged in a h-th column (h is an integer number equal to or greater than 1) comprise a first logic pixel and a second logic pixel, which are sequentially arranged in the second direction, the pixels arranged in a (h+1)th column comprise a third logic pixel and a fourth logic pixel, which are sequentially arranged in the second direction, and each of the first, second, third, and fourth logic pixels comprises an even number of sub-pixels.

5. The display apparatus of claim 4, wherein each of the first and fourth logic pixels comprises two pixels of red, green, blue, and white pixels, and each of the second and third logic pixels comprises the other two pixels of the red, green, blue, and white pixels.

6. The display apparatus of claim 5, wherein the first pixels are included in the pixels arranged in the h-th column and the second pixels are included in the pixels arranged in the (h+1)th column.

7. The display apparatus of claim 1, wherein the first pixels are included in the pixels arranged in the i-th row, and the second pixels are included in the pixels arranged in the (i+2)th row.

8. The display apparatus of claim 7, wherein the pixels disposed between a h-th data line and a (h+1)th data line among the data lines are alternately connected to the h-th data line and the (h+1)th data line in the unit of at least one pixel.

9. The display apparatus of claim 8, wherein a polarity of data voltages applied to the data lines is inverted every one data line.

10. The display apparatus of claim 8, wherein the k-th gate line and a (k+1)th gate lines are disposed between the pixels arranged in the i-th row and the pixels arranged in the (i+1)th row, and the pixels arranged in the i-th row are alternately connected to the k-th gate line and the (k+1)th gate line in the unit of one pixel.

11. The display apparatus of claim 1, wherein the pixels arranged between a h-th data line and a (h+1)th data line are commonly connected to one of the h-th data line and the (h+1)th data line.

12. The display apparatus of claim 11, wherein a polarity of data voltages applied to the data lines is inverted every one data line.

* * * * *